US011281125B2

(12) United States Patent
Lee et al.

(10) Patent No.: US 11,281,125 B2
(45) Date of Patent: Mar. 22, 2022

(54) TONER REFILL CARTRIDGE WITH STRUCTURE FOR PREVENTING TONER DISCHARGING PART FROM BEING BLOCKED BY WEIGHT PART

(71) Applicant: Hewlett-Packard Development Company, L.P., Spring, TX (US)

(72) Inventors: Seung-Gweon Lee, Seongnam-si (KR); Woong-Yong Choi, Seongnam-si (KR); Jinhwa Hong, Seongnam-si (KR); Ji-Won Moon, Seongnam-si (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/059,592

(22) PCT Filed: Aug. 9, 2019

(86) PCT No.: PCT/US2019/045927

§ 371 (c)(1),
(2) Date: Nov. 30, 2020

(87) PCT Pub. No.: WO2020/180344

PCT Pub. Date: Sep. 10, 2020

(65) Prior Publication Data

US 2021/0263448 A1 Aug. 26, 2021

(30) Foreign Application Priority Data

Mar. 6, 2019 (KR) ..... 10-2019-0025651

(51) Int. Cl.

| | |
|---|---|
| ***G03G 15/08*** | (2006.01) |
| ***G03G 21/18*** | (2006.01) |
| *G03G 21/16* | (2006.01) |

(52) U.S. Cl.
CPC ..... *G03G 15/0894* (2013.01); *G03G 15/0865* (2013.01); *G03G 21/181* (2013.01); *G03G 15/0867* (2013.01); *G03G 21/1633* (2013.01)

(58) Field of Classification Search
CPC ..... G03G 15/0894; G03G 21/181; G03G 15/0865; G03G 15/0867; G03G 15/0877;
(Continued)

(56) References Cited

U.S. PATENT DOCUMENTS 5,508,794 A * 4/1996 Ikesue ..... G03G 15/0822 399/120
5,774,772 A 6/1998 Kai et al.
(Continued)

FOREIGN PATENT DOCUMENTS

EP 2 628 605 A1 8/2013
JP 08137229 A * 5/1996
(Continued)

*Primary Examiner* — Walter L Lindsay, Jr.
*Assistant Examiner* — Laura Roth
(74) *Attorney, Agent, or Firm* — Jefferson IP Law, LLP

(57) ABSTRACT

An example toner refill cartridge includes a body, a plunger, a weight part, and a weight part container. The body includes a toner chamber to contain toner and a toner discharging portion having an entrance connected to one end of the toner chamber in a length direction and an exit to discharge toner. The plunger includes a piston that is movably inserted into the toner chamber in the length direction and a packing member located at an end of the piston to push the toner toward the toner discharging portion. The weight part is movably accommodated in the toner chamber and has a shape that prevents the weight part from passing through the entrance. The weight part container is provided in the one end of the toner chamber in the length direction such that the weight part can be accommodated therein.

20 Claims, 13 Drawing Sheets

(58) Field of Classification Search
CPC ..... G03G 21/185; G03G 15/6573; G03G 2215/0636; G03G 21/18; G03G 15/6552; G03G 2215/00421; G03G 15/0874; G03G 2221/169; G03G 21/1633
See application file for complete search history.

(56) References Cited

U.S. PATENT DOCUMENTS

| | | | | |
|---|---|---|---|---|
| 6,270,276 | B1 | 8/2001 | Virgo | |
| 6,862,420 | B1 | 3/2005 | Less | |
| 7,904,007 | B2 | 3/2011 | Takesue et al. | |
| 2011/0158738 | A1 | 6/2011 | Bainbridge et al. | |
| 2021/0096483 | A1* | 4/2021 | Takarada ..... | G03G 21/1814 |
| 2021/0109457 | A1* | 4/2021 | Wada ..... | G03G 15/5004 |

FOREIGN PATENT DOCUMENTS

| | | | | |
|---|---|---|---|---|
| JP | 2000-189304 | A | | 7/2000 |
| JP | 2003084549 | A | * | 3/2003 |
| JP | 2010-266581 | A | | 11/2010 |
| JP | 2016-10665 | A | | 1/2016 |
| WO | WO-2015/057378 | A1 | | 4/2015 |

* cited by examiner

TONER REFILL CARTRIDGE WITH STRUCTURE FOR PREVENTING TONER DISCHARGING PART FROM BEING BLOCKED BY WEIGHT PART

BACKGROUND

An image forming apparatus using an electrophotographic method is an apparatus in which toner is supplied to an electrostatic latent image formed on a photoconductor to form a visible toner image on the photoconductor, and the toner image is transferred via an intermediate transfer medium or directly to a print medium and then the transferred toner image is fixed on the print medium.

A development cartridge contains toner and supplies the toner to the electrostatic latent image formed on the photoconductor to form a visible toner image. When the toner in the development cartridge is used up, the development cartridge is removed from a main body of the image forming apparatus, and a new development cartridge may be mounted on the main body of the image forming apparatus. The development cartridge may also be refilled with a new toner by using a toner refill kit (toner refill cartridge).

DETAILED DESCRIPTION OF EXAMPLES

Figure 1:
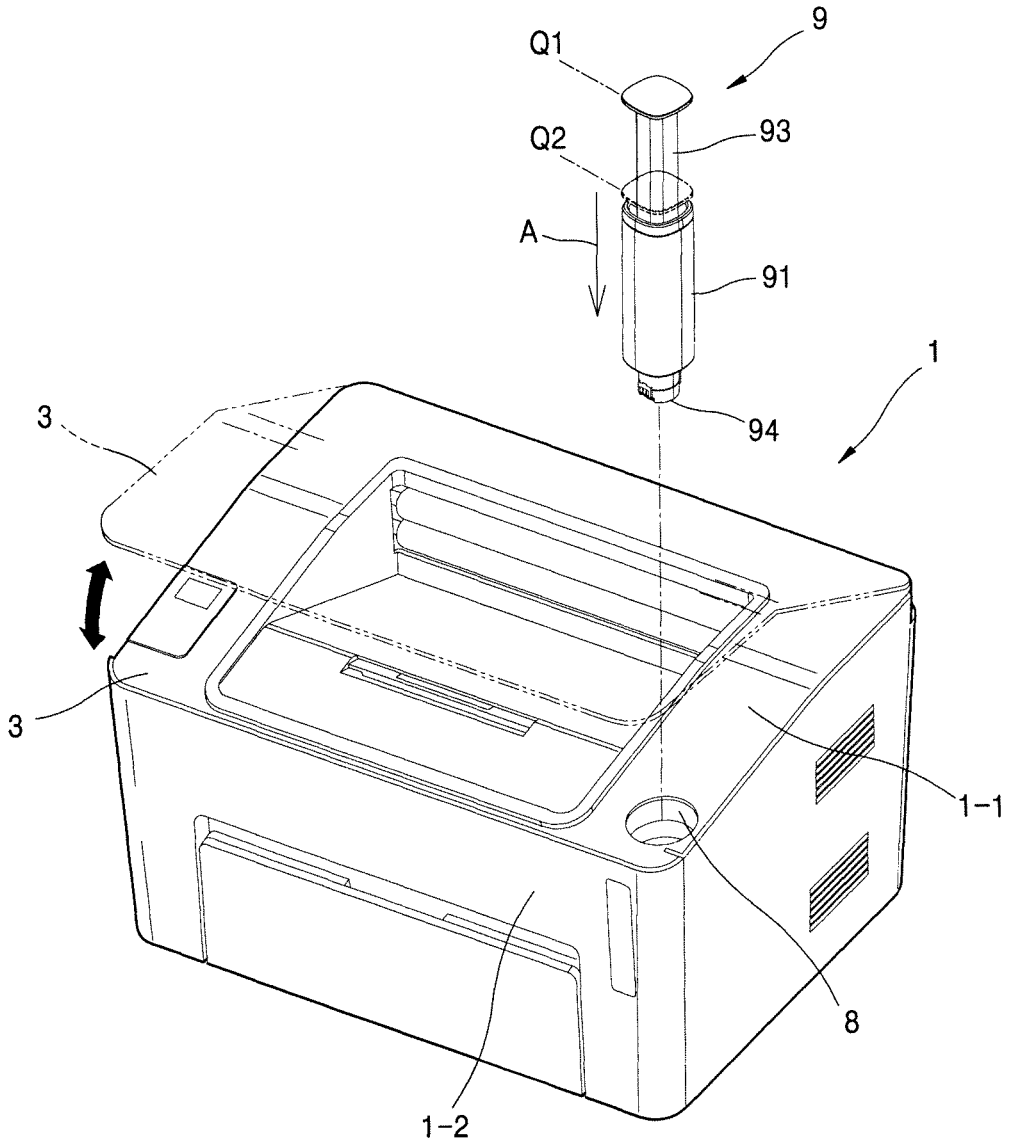
FIG. 1 is a schematic perspective view of the exterior of an electrophotographic image forming apparatus according to an example.
Figure 2:
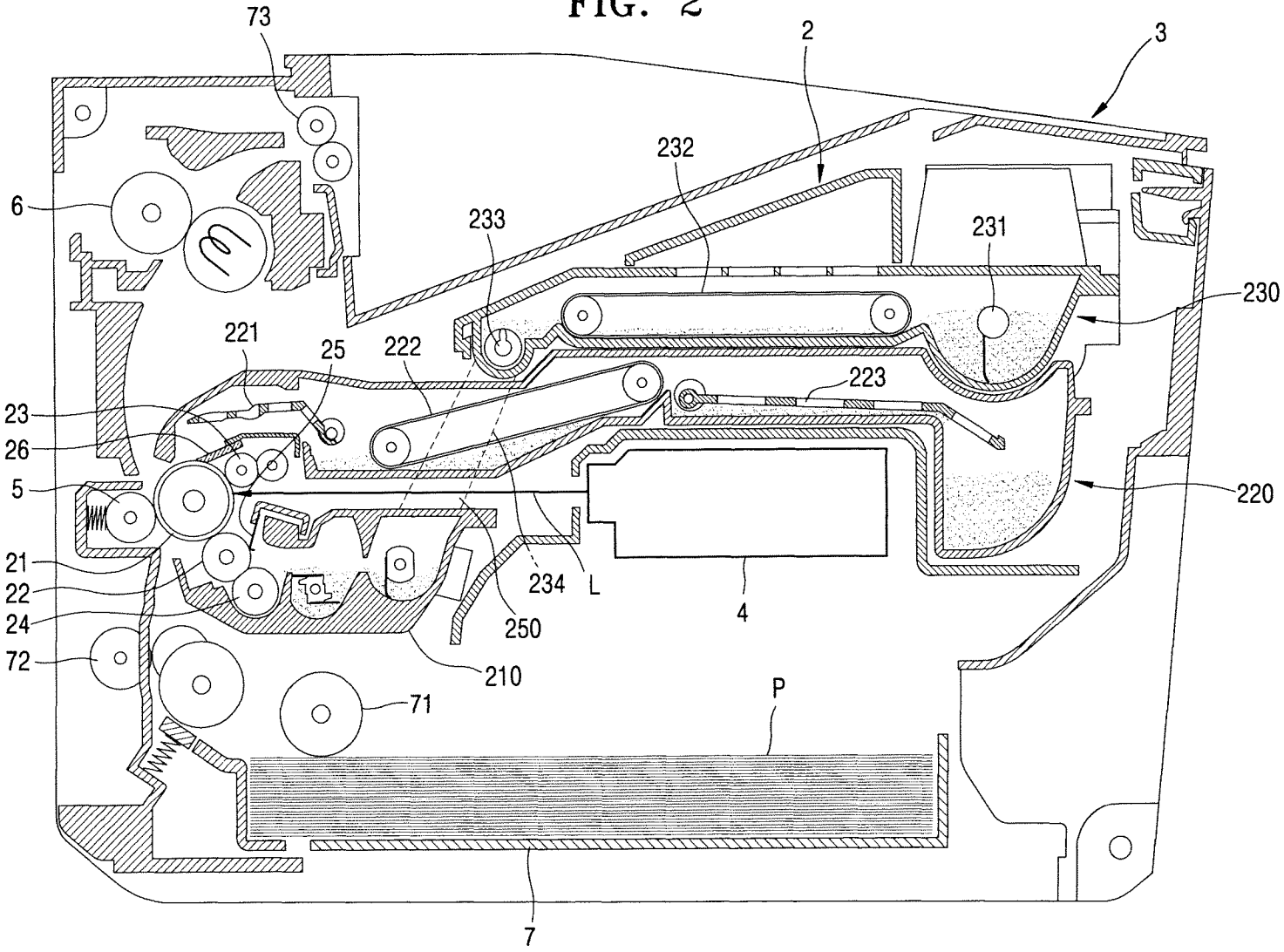
FIG. 2 is a schematic structural diagram of the electrophotographic image forming apparatus of FIG. 1 according to an example.
Figure 3:
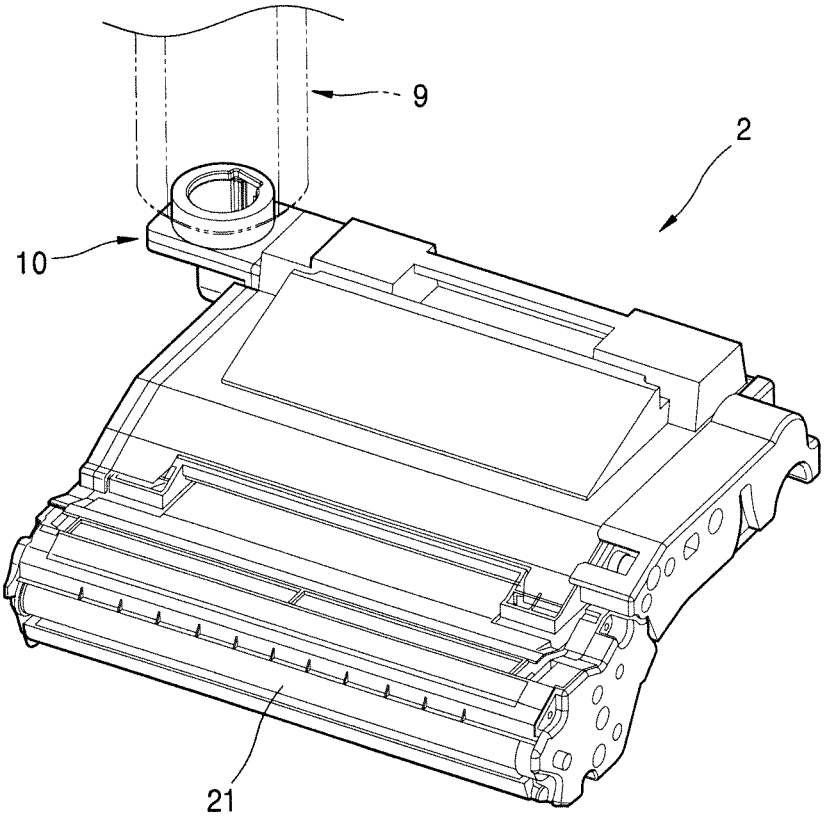
FIG. 3 is a perspective view of a development cartridge included in the electrophotographic image forming apparatus illustrated in FIG. 1, according to an example.

FIG. 1 is a schematic perspective view of the exterior of an electrophotographic image forming apparatus according to an example. FIG. 2 is a schematic structural diagram of the electrophotographic image forming apparatus of FIG. 1 according to an example. FIG. 3 is a perspective view of a development cartridge included in the electrophotographic image forming apparatus illustrated in FIG. 1, according to an example. Referring to FIGS. 1, 2, and 3, the electrophotographic image forming apparatus may include a main body 1 and a development cartridge 2 that is detachably attached to the main body 1. A door 3 may be provided in the main body 1. The door 3 opens or closes a portion of the main body 1. While the door 3 opening an upper portion of the main body 1 is illustrated in FIG. 1, a door opening a side portion or a front portion of the main body 1 may be employed. The development cartridge 2 may be mounted to or removed from the main body 1 by opening the door 3.

A photosensitive drum 21 is an example of a photoconductor on which an electrostatic latent image is formed, and may include a cylindrical metal pipe and a photoconductive layer formed on an outer circumference of the metal pipe. A charging roller 23 is an example of a charger that charges a surface of the photosensitive drum 21 to have a uniform electric potential. A charge bias voltage is applied to the charging roller 23. Instead of the charging roller 23, a corona charger (not shown) may be used. A developing roller 22 supplies toner to an electrostatic latent image formed on a surface of the photosensitive drum 21 to develop the electrostatic latent image.

In a two-component developing method in which toner and a carrier are used as a developer, the developing roller 22 may be in the form of a sleeve, inside of which a magnet is fixed. The sleeve may be located apart from the photosensitive drum 21 by tens to hundreds of micrometers. The carrier is attached to an outer circumference of the developing roller 22 via a magnetic force of a magnet, and the toner is attached to the carrier via an electrostatic force, thereby forming a magnetic brush including the carrier and the toner on the outer circumference of the developing roller 22. According to a developing bias voltage applied to the developing roller 22, the toner is moved to the electrostatic latent image formed on the photosensitive drum 21.

In a one-component developing method in which toner is used as a developer, the developing roller 22 may be in contact with the photosensitive drum 21 and may be located apart from the photosensitive drum 21 by tens to hundreds of micrometers. In the example, a one-component contact developing method in which the developing roller 22 and the photosensitive drum 21 contact each other to form a developing nip is used. The developing roller 22 may be in the form of an elastic layer (not shown) formed on an outer circumference of a conductive metal core (not shown). When a developing bias voltage is applied to the developing roller 22, the toner is moved via the developing nip, to the electrostatic latent image formed on a surface of the photosensitive drum 21 to be attached to the electrostatic latent image.

A supplying roller 24 attaches the toner to the developing roller 22. A supply bias voltage may be applied to the supplying roller 24 to attach the toner to the developing roller 22. Reference numeral 25 denotes a regulating member regulating a toner amount attached to the surface of the developing roller 22. The regulating member 25 may be, for example, a regulating blade having a front end that contacts the developing roller 22 at a certain pressure. Reference numeral 26 denotes a cleaning member used to remove residual toner and foreign substances from the surface of the photosensitive drum 21 before charging. The cleaning member 26 may be, for example, a cleaning blade having a front end that contacts the surface of the photosensitive drum 21 at a certain pressure. Hereinafter, foreign substances removed from the surface of the photosensitive drum 21 will be referred to as waste toner.

An optical scanner 4 scans light modulated according to image information, onto a surface of the photosensitive drum 21 charged to a uniform electric potential. As the optical scanner 4, for example, a laser scanning unit (LSU) that scans light radiated from a laser diode onto the photosensitive drum 21 by deflecting the light by using a polygon mirror, in a main scanning direction, may be used.

A transfer roller 5 is an example of a transfer unit that is located to face the photosensitive drum 21 to form a transfer nip. A transfer bias voltage used to transfer a toner image developed on the surface of the photosensitive drum 21 to a print medium P is applied to the transfer roller 5. Instead of the transfer roller 5, a corona transfer unit may be used.

The toner image transferred to a surface of the print medium P via the transfer roller 5 is maintained on the surface of the print medium P due to an electrostatic attractive force. A fusing unit 6 fuses the toner image on the print medium P by applying heat and pressure to the toner image, thereby forming a permanent print image on the print medium P.

Referring to FIGS. 2 and 3, the development cartridge 2 according to the example includes a developing portion 210 in which the photosensitive drum 21 and the developing roller 22 are mounted, a waste toner chamber 220 receiving waste toner removed from the photosensitive drum 21, and a toner container 230 connected to the developing portion 210 and containing toner. In order to refill toner in the toner container 230, the development cartridge 2 includes a toner refilling portion 10 connected to the toner container 230. The toner refilling portion 10 provides an interface with respect to the toner refill cartridge 9 which will be described later and the development cartridge 2. The development cartridge 2 is an integrated type development cartridge including the developing portion 210, the waste toner chamber 220, the toner container 230, and the toner refilling portion 10.

A portion of an outer circumference of the photosensitive drum 21 is exposed outside a housing. A transfer nip is formed as the transfer roller 5 contacts an exposed portion of the photosensitive drum 21. At least one conveying member conveying toner towards the developing roller 22 may be installed in the developing portion 210. The conveying member may also perform a function of charging toner to a certain electric potential by agitating the toner.

The waste toner chamber 220 is located above the developing portion 210. The waste toner chamber 220 is spaced apart from the developing portion 210 in an upward direction to form a light path 250 therebetween. Waste toner removed from the photosensitive drum 21 by using the cleaning member 26 is received in the waste toner chamber 220. The waste toner removed from the surface of the photosensitive drum 21 is fed into the waste toner chamber 220 via one or more waste toner feeding members 221, 222, and 223. The shape and number of waste toner feeding members are not limited. An appropriate number of waste toner feeding members may be installed at appropriate locations to distribute waste toner effectively in the waste toner chamber 220 by considering a volume or shape of the waste toner chamber 220.

The toner container 230 is connected to the toner refilling portion 10 to receive toner. The toner container 230 is connected to the developing portion 210 via a toner supplier 234 as denoted by a dashed line illustrated in FIG. 2. As illustrated in FIG. 2, the toner supplier 234 may pass through the waste toner chamber 220 vertically to be connected to the developing portion 210. The toner supplier 234 is located outside an effective width of exposed light L such that the toner supplier 234 does not interfere with the exposed light L scanned in a main scanning direction by using the optical scanner 4.

One or more toner supplying members 231, 232, and 233 used to supply toner to the developing portion 210 through the toner supplier 234 may be installed in the toner container 230. The shape and number of toner supplying members are not limited. An appropriate number of toner supplying members may be installed at appropriate locations to supply toner effectively to the developing portion 210 by considering a volume or shape of the toner container 230. The toner supplying member 233 may convey toner in a main scanning direction to transfer the same to the toner supplier 234.

An image forming process according to the above-described configuration will be described briefly. A charge bias is applied to the charging roller 23, and the photosensitive drum 21 is charged to a uniform electric potential. The optical scanner 4 scans light modulated in accordance with image information, onto the photosensitive drum 21, thereby forming an electrostatic latent image on a surface of the photosensitive drum 21. The supplying roller 24 attaches the toner to a surface of the developing roller 22. The regulating member 25 forms a toner layer having a uniform thickness on the surface of the developing roller 22. A developing bias voltage is applied to the developing roller 22. As the developing roller 22 is rotated, toner conveyed to a developing nip is moved and attached to the electrostatic latent image formed on the surface of the photosensitive drum 21 via the developing bias voltage, thereby forming a visible toner image on the surface of the photosensitive drum 21. The print medium P withdrawn from a loading tray 7 via a pickup roller 71 is fed, via a feeding roller 72, to the transfer nip where the transfer roller 5 and the photosensitive drum 21 face each other. When a transfer bias voltage is applied to the transfer roller 5, the toner image is transferred to the print medium P via an electrostatic attractive force. As the toner image transferred to the print medium P receives heat and pressure from the fusing unit 6, the toner image is fused to the print medium P, thereby completing printing. The print medium P is discharged by using a discharge roller 73. The toner that is not transferred to the print medium P but remains on the surface of the photosensitive drum 21 is removed by using the cleaning member 26.

As described above, the development cartridge 2 supplies the toner contained in the toner container 230 to the electrostatic latent image formed on the photosensitive drum 21 to form a visible toner image, and is attachable to/detachable from the main body 1. In addition, the development cartridge 2 includes the toner refilling portion 10 used to refill toner. The toner refilling portion 10 may be integrated with the development cartridge 2 and thus may be attachable to/detachable from the main body 1 together with the development cartridge 2. According to the image forming apparatus of the example, without removing the development cartridge 2 from the main body 1, toner may be refilled in the development cartridge 2 while the development cartridge 2 is mounted in the main body 1.

Referring to FIG. 1, the toner refill cartridge 9 may be a syringe-type toner refill cartridge including a body 91 containing toner and including a toner discharging portion 94 and a plunger 93 that is movably coupled to the body 91 in a length direction A to push the toner out of the body 91. The toner discharging portion 94 may be provided at a front end portion of the body 91. A discharge shutter (not shown) selectively opening or closing the toner discharging portion 94 may be provided at the front end portion of the body 91. In the syringe-type toner refill cartridge 9, the plunger 93 may be located at a top dead position Q1 (FIG. 1) in an initial stage. The plunger 93 may be moved to a bottom dead position Q2 (FIG. 1) to refill toner in the toner container 230.

A communicating portion 8 is provided in the main body 1 to provide access to the toner refilling portion 10 from the outside while the development cartridge 2 is mounted in the main body 1. The communicating portion 8 may be located relatively close to a front portion 1-2 of the main body 1. As the front portion 1-2 faces a user, the user may easily access the communicating portion 8. Accordingly, a toner refilling job through the communicating portion 8 may be performed easily. The communicating portion 8 may be provided in an upper surface 1-1 of the main body 1. The toner refilling portion 10 is located under the communicating portion 8. The communicating portion 8 and the toner refilling portion 10 may be aligned vertically. The toner refill cartridge 9 may access the toner refilling portion 10 via the communicating portion 8 from above the main body 1.

For example, when the toner refill cartridge 9 is inserted into the communicating portion 8 from above the main body 1, as illustrated in FIG. 3, the toner refill cartridge 9 may be connected to the toner refilling portion 10. When pressing the plunger 93 in a length direction A while the toner refill cartridge 9 is mounted in the toner refilling portion 10, the toner received in the body 91 is discharged through the toner discharging portion 94 to be supplied to the toner container 230 of the development cartridge 2 through the toner refilling portion 10. After toner refilling is completed, the toner refill cartridge 9 is removed from the communicating portion 8.

According to this configuration, as toner is refilled in the toner container 230 by using the toner refilling portion 10, a replacement time of the development cartridge 2 may be extended until the lifetime of the photosensitive drum 21 ends, thereby reducing printing costs per sheet. In addition, toner may be refilled while the development cartridge 2 is mounted in the main body 1, and thus, user convenience may be increased.

When the toner refill cartridge 9 is left unused for a long time, toner in the body 91 may be compacted. In such a state, mobility of the toner is very low and toner may not be easily discharged through the toner discharging portion 94 even when pressing the plunger 93. It is difficult to ensure sufficient toner mobility of the compacted toner just by shaking the toner refill cartridge 9. Thus, a weight part is placed inside the body 91 to resolve the compactness of the toner. The compactness of the toner may be easily resolved as the weight part is moved inside the body 91 when a user shakes the toner refill cartridge 9. Also, sound is generated by movement of the weight part, and thus, the extent of the user's shaking may be easily recognized. However, the toner discharging portion 94 may be completely or partially blocked by the weight part, making discharging of the toner difficult. Hereinafter, the toner refill cartridge 9 according to an example, which has a structure in which the toner discharging portion 94 may be prevented from being blocked by the weight part, will be described.

Figure 4:
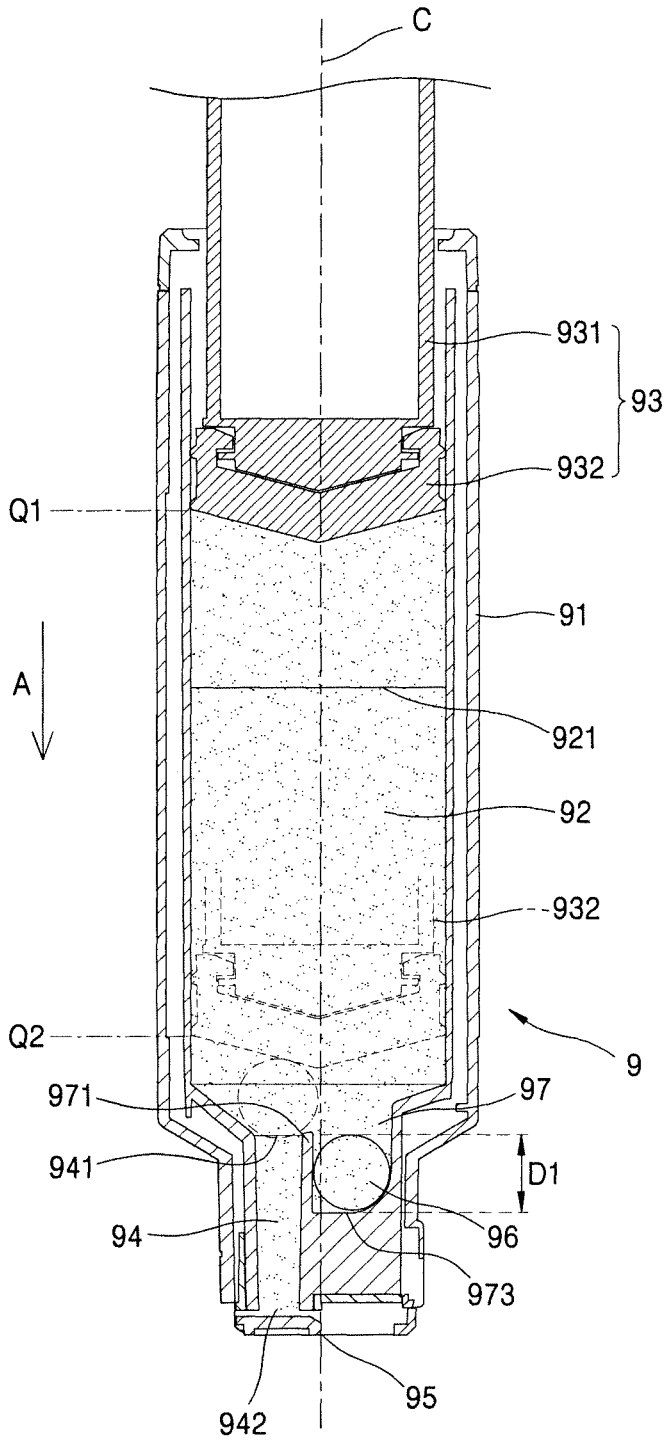
FIG. 4 is a vertical cross-sectional view of a toner refill cartridge according to an example.
Figure 5:
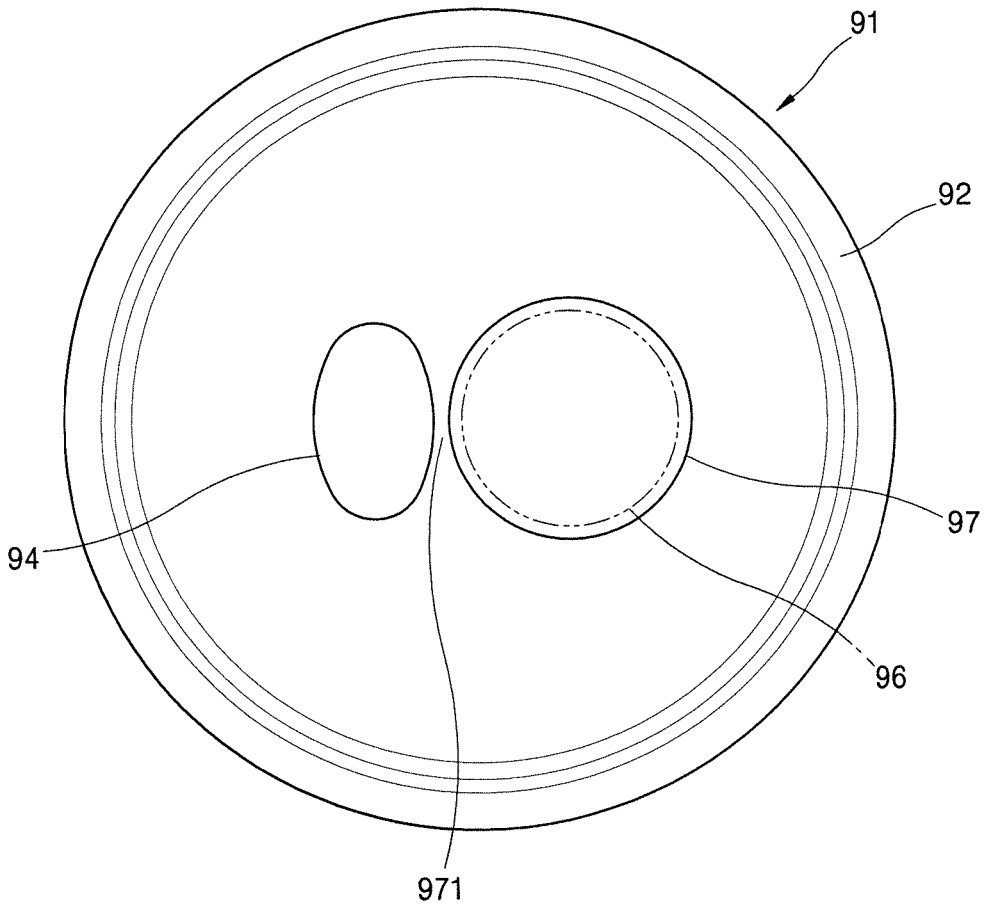
FIG. 5 is a schematic horizontal cross-sectional view of the toner refill cartridge illustrated in FIG. 4, according to an example.

FIG. 4 is a vertical cross-sectional view of the toner refill cartridge 9 according to an example. FIG. 5 is a schematic horizontal cross-sectional view of the toner refill cartridge 9 illustrated in FIG. 4, according to an example. In FIG. 5, the body 91 is simplified.

Referring to FIGS. 4 and 5, the toner refill cartridge 9 may include a body 91 including a toner chamber 92 containing toner and a toner discharging portion 94 through which toner is discharged, a plunger 93 that is movably inserted into the toner chamber 92 in a length direction A to push the toner to the outside through the toner discharging portion 94, and a weight part 96 that is movably accommodated in the toner chamber 92.

The toner discharging portion 94 may include an entrance 941 connected to one end of the toner chamber 92 and an exit 942 communicating with the outside. The toner discharging portion 94 may be extended from the entrance 941 in the length direction A.

The plunger 93 is movably coupled to the body 91 from the other end of the toner chamber 92 in the length direction A to push the toner contained in the toner chamber 92 out of the body 91 through the toner discharging portion 94. The plunger 93 may include a piston 931 movably inserted into the toner chamber 92 in the length direction A and a packing member 932 located at an end of the piston 931 to push the toner toward the toner discharging portion 94. The packing member 932 may be an elastic body that closely contacts an inner wall of the toner chamber 92, for example, rubber.

The weight part 96 is accommodated in the toner chamber 92. When the user shakes the toner refill cartridge 9, the weight part 96 is freely moved inside the toner chamber 92 to pulverize the compacted toner to impart mobility to the toner. The weight part 96 is heavier than toner particles. For example, the weight part 96 may have a weight of 10 g or more. The weight part 96 has a size that is not passable through the toner discharging portion 94. A shape of the weight part 96 is not limited, and the weight part 96 may be, for example, a sphere.

Reference numeral 95 is a shutter that selectively opens or closes the toner discharging portion 94. For example, the shutter 95 may open the toner discharging portion 94 by interacting with the toner refilling portion 10 when the toner refill cartridge 9 is mounted in the toner refilling portion 10.

When the toner refill cartridge 9 is left unused for a long time as described above, toner in the toner chamber 92 is compacted. Then, gaps between toner particles are reduced, thus lowering a toner level in the toner chamber 92 as marked by reference numeral 921. In this state, toner mobility is very low, and thus, toner is not easily discharged. According to the toner refill cartridge 9 of the example, before mounting the toner refill cartridge 9 in the toner refilling portion 10, the toner refill cartridge 9 is shaken. Then, the weight part 96 is freely moved in the toner chamber 92 to increase gaps between the toner particles and increase toner mobility. When the toner refill cartridge 9 is erected as illustrated in FIG. 4 to mount the toner refill cartridge 9 in the toner refilling portion 10, the weight part 96, which is heavy, is moved downward due to gravity. Here, as marked by a dashed line in FIG. 4, when the weight part 96 is placed on the entrance 941 of the toner discharging portion 94, the toner discharging portion 94 may be blocked completely or partially, and thus, despite pressing the plunger 93 in the length direction A, toner may not be easily discharged. Also, the packing member 932 may contact the weight part 96 that is placed on the entrance 941 of the toner discharging portion 94 and thus may not be moved downwards up to the bottom dead position Q2.

The toner refill cartridge 9 according to the example includes a weight part container engraved in the one end of the toner chamber 92 in the length direction A such that the weight part 96 is accommodated in the weight part container. According to this configuration, as the toner refill cartridge 9 is erected, the weight part 96, which is heavier than toner particles, is accommodated in the weight part container that is engraved at a lower level than the entrance 941 of the toner discharging portion 94. Accordingly, the possibility that the weight part 96 is placed on the entrance 941 of the toner discharging portion 94 may be reduced.

According to an example, the weight part container may include a first weight part container 97 that is engraved in the vicinity of the entrance 941 and formed not to overlap the entrance 941. The first weight part container 97 is engraved from the entrance 941 in the length direction A, that is, toward the exit 942, to have a first depth D1. The first weight part container 97 is divided from the toner discharging portion 94 via a barrier 971.

According to this configuration, by erecting the toner refill cartridge 9, the weight part 96, which is heavier than toner particles, is lowered to a lower portion of the toner chamber 92 by gravity to enter the first weight part container 97 that is at a lower level than the entrance 941 of the toner discharging portion 94. As the entrance 941 of the toner discharging portion 94 may be maintained in an opened state, by lowering the plunger 93, toner may be easily discharged to the outside through the toner discharging portion 94. Also, the packing member 932 may be lowered up to the bottom dead position Q2 as marked by the dashed line in FIG. 4, and thus, the amount of residual toner in the toner chamber 92 may be reduced, thus increasing a toner use efficiency.

According to the example, the toner discharging portion 94 is located to be deviated from a central axis C of the body 91, and the one end of the toner chamber 92 is tilted downwards toward the entrance 941 of the toner discharging portion 94. Thus, by erecting the toner refill cartridge 9, the weight part 96 may be easily moved along the one end of the toner chamber 92 to the first weight part container 97 to be accommodated therein.

The first depth D1 may be equal to or greater than a diameter of the weight part 96. According to this configuration, the weight part 96 may be completely accommodated in the first weight part container 97.

Figure 6:
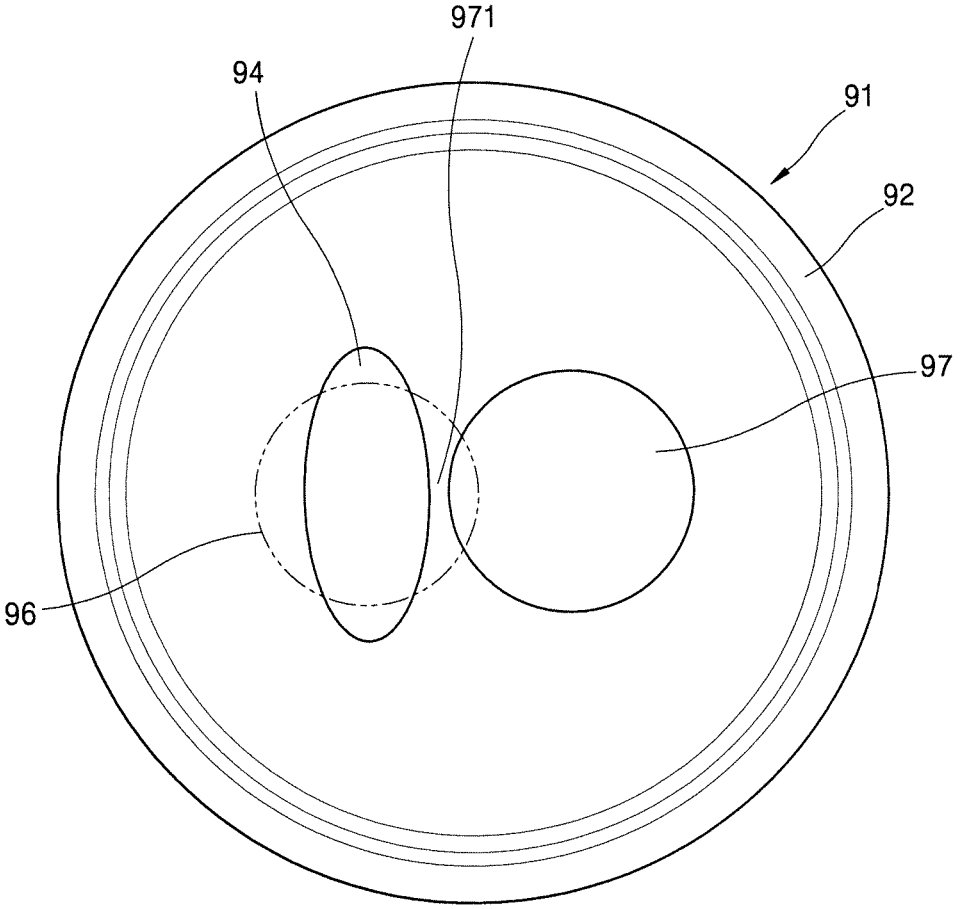
FIG. 6 is a horizontal cross-sectional view of a toner refill cartridge according to an example.

FIG. 6 is a horizontal cross-sectional view of the toner refill cartridge 9 according to an example. In FIG. 6, the body 91 is simplified. Referring to FIG. 6, a projected shape of the toner discharging portion 94 in the length direction A may have a shape having a major axis and a minor axis. A length of the minor axis may be less than the diameter of the weight part 96, and a length of the major axis may be greater than the diameter of the weight part 96. According to this configuration, the weight part 96 may not pass through the toner discharging portion 94. Also, even when the weight part 96 is not accommodated in a weight part container, for example, the first weight part container 97, but is placed on the entrance 941 of the toner discharging portion 94 as marked by a dashed line, the toner discharging portion 94 is in a partially opened state, and thus, toner may be discharged through the toner discharging portion 94.

Figure 7:
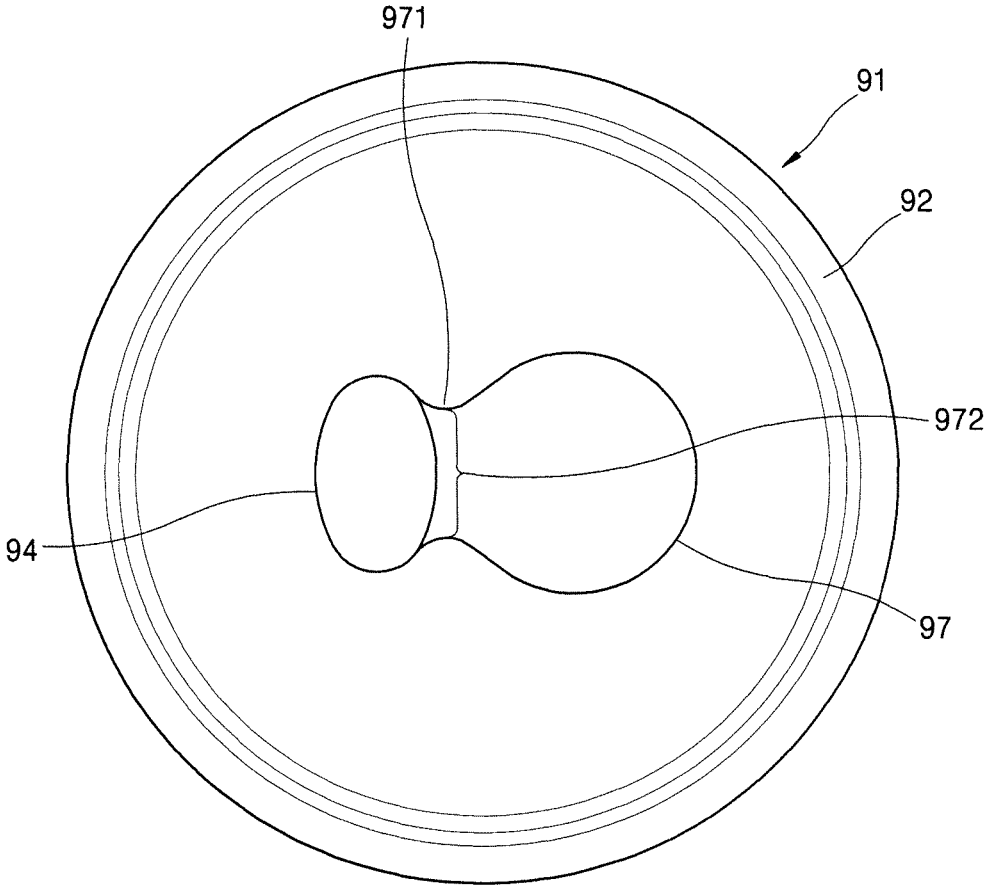
FIG. 7 is a horizontal cross-sectional view of a toner refill cartridge according to an example.

FIG. 7 is a horizontal cross-sectional view of the toner refill cartridge 9 according to an example. In FIG. 7, the body 91 is simplified. Referring to FIG. 7, a first communication port 972 communicating the toner discharging portion 94 with the first weight part container 97 is provided in a barrier 971. The first communication port 972 may extend from an upper end of the barrier 971 to a bottom 973 of the first weight part container 97. A size of the first communication port 972 may be less than the diameter of the weight part 96 such that the weight part 96 accommodated in the first weight part container 97 does not enter the toner discharging portion 94.

According to this configuration, as the toner that has entered the first weight part container 97 from the toner chamber 92 may be discharged through the first communication port 972 and the toner discharging portion 94, a toner use efficiency may be increased. Also, when the weight part 96 is not accommodated in the first weight part container 97 but is placed on the entrance 941 of the toner discharging portion 94 as marked by the dashed line illustrated in FIG. 4, the toner discharging portion 94 may be blocked partially or completely. According to the example, the first weight part container 97 and the first communication port 972 may act as a path connecting the toner chamber 92 to the toner discharging portion 94. By pressing the plunger 93, the toner in the toner chamber 92 may be discharged to the outside through the first weight part container 97, the first communication port 972, and the toner discharging portion 94. Accordingly, according to the toner refill cartridge 9 of the example, the operational reliability of the toner refill cartridge 9 may be improved.

Figure 8:
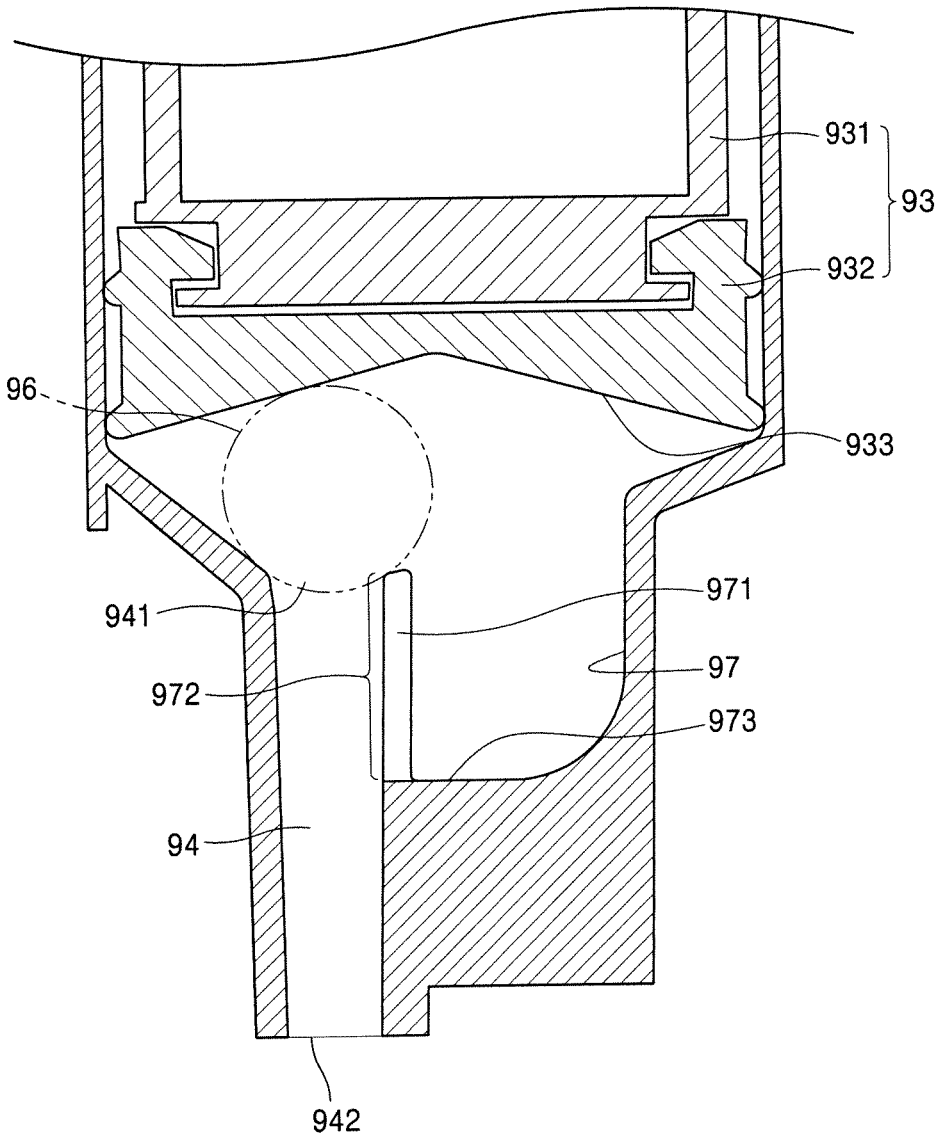
FIG. 8 is a vertical cross-sectional view of a toner refill cartridge according to an example.

FIG. 8 is a vertical cross-sectional view of the toner refill cartridge 9 according to an example. In FIG. 8, an area near the toner discharging portion 94 is illustrated briefly. The example illustrated in FIG. 8 is different from the example illustrated in FIG. 7 in that the bottom 933 of the packing member 932, that is, a surface of the packing member 932 facing the toner discharging portion 94, is concave.

The weight part 96 may not be accommodated in the first weight part container 97, but may be placed on the entrance 941 of the toner discharging portion 94 as illustrated by a two-dot chain line. In this case, as the packing member 932 is moved in the length direction A, the toner in the toner chamber 92 may be discharged to the outside through the first weight part container 97, the first communication port 972, and the toner discharging portion 94. The packing member 932 may be moved in the length direction A until the bottom 933 contacts the weight part 96. According to the example, by employing the packing member 932 having the bottom 933, which is concave, the packing member 932 may be moved closer to the toner discharging portion 94. Accordingly, the amount of residual toner in the toner chamber 92 may be reduced, thereby increasing a toner use efficiency.

Figure 9:
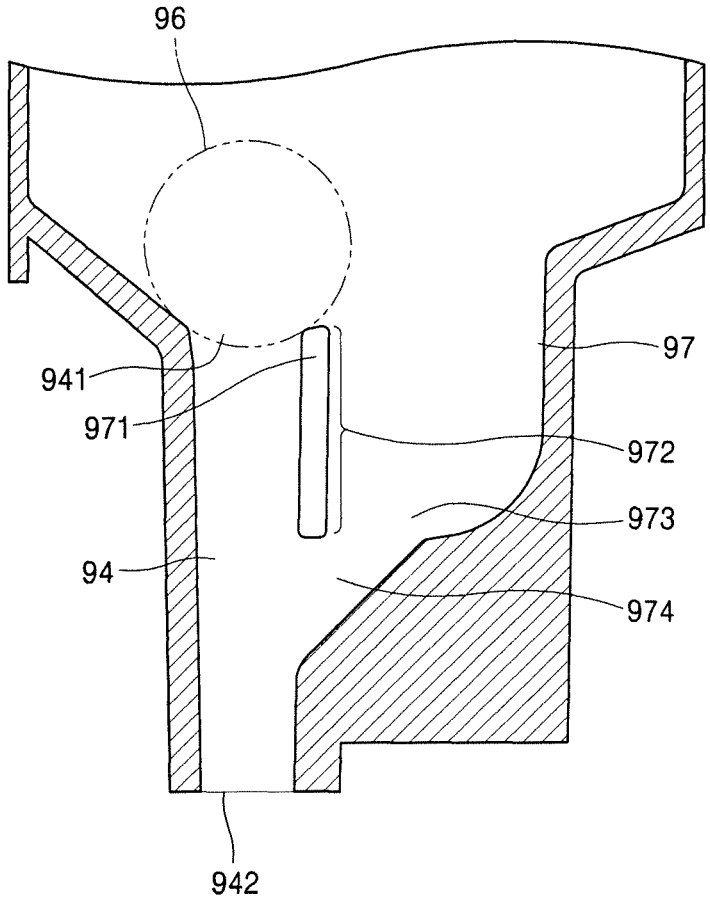
FIG. 9 is a vertical cross-sectional view of a toner refill cartridge according to an example.

FIG. 9 is a vertical cross-sectional view of the toner refill cartridge 9 according to an example. In FIG. 9, an area near the toner discharging portion 94 is illustrated briefly. Referring to FIG. 9, a first communication port 972 extending from the upper end of the barrier 971 to the bottom 973 of the first weight part container 97 to communicate the toner discharging portion 94 with the first weight part container 97 and a second communication port 974 connecting the bottom 973 of the first weight part container 97 to the toner discharging portion 94 at an angle are illustrated. The second communication port 974 extends from the bottom 973 of the first weight part container 97 toward the toner discharging portion 94 in the length direction A at an angle in a downward direction. The second communication port 974 is connected to the first communication port 972. The first communication port 972 and the second communication port 974 have a size smaller than a diameter of the weight part 96 such that the weight part 96 accommodated in the first weight part container 97 does not enter the toner discharging portion 94.

According to this configuration, the toner in the first weight part container 97 may be easily discharged through the toner discharging portion 94, thus increasing a toner use efficiency. Also, when the weight part 96 is not accommodated in the first weight part container 97 but is placed on the entrance 941 of the toner discharging portion 94 as illustrated by a two-dot chain line in FIG. 9, by pressing the plunger 93, the toner in the toner chamber 92 may be discharged to the outside through the first weight part container 97, the first communication port 972, the second communication port 974, and the toner discharging portion 94. Accordingly, according to the toner refill cartridge 9 of the example, the operational reliability of the toner refill cartridge 9 may be improved.

The packing member 932 illustrated in FIG. 8 having the bottom 933, which is concave, may also be applied to the example illustrated in FIG. 9. Also, the toner discharging portion 94 having the shape illustrated in FIG. 6 may be applied to the example illustrated in FIG. 9.

Another example for moving the packing member 932 closer to the toner discharging portion 94 when the weight part 96 is not accommodated in the first weight part container 97 but is placed on the entrance 941 of the toner discharging portion 94 will be described.

Figure 10:
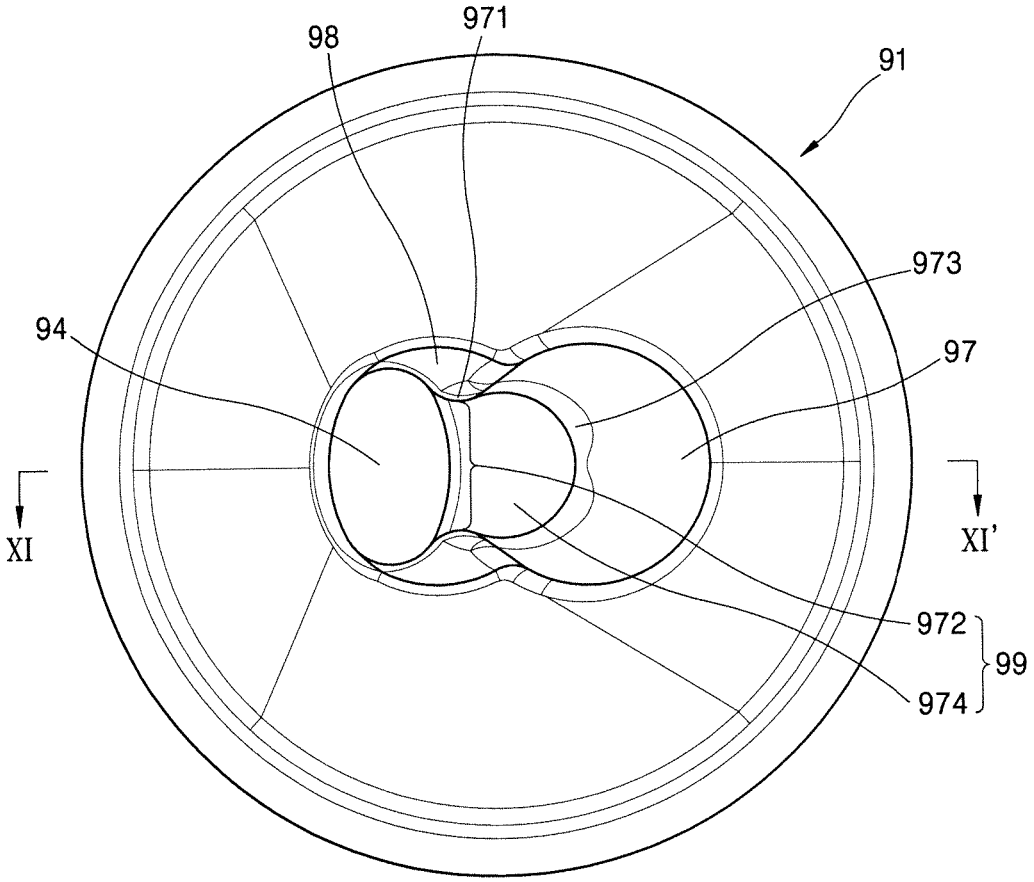
FIG. 10 is a horizontal cross-sectional view of a toner refill cartridge according to an example.
Figure 11:
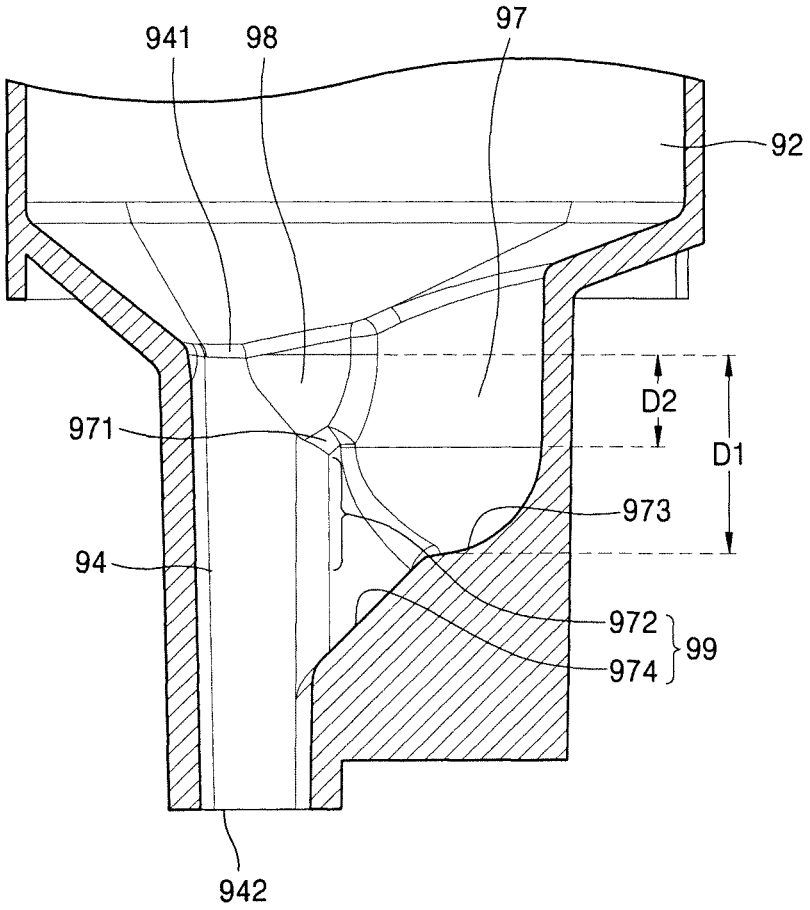
FIG. 11 is a cross-sectional view of the toner refill cartridge illustrated in FIG. 10 taken along line XI-XI'.

FIG. 10 is a horizontal cross-sectional view of the toner refill cartridge 9 according to an example. FIG. 11 is a cross-sectional view of the toner refill illustrated in FIG. 10 taken along line XI-XI'. Referring to FIG. 11, the toner refill cartridge 9 includes a first weight part container 97, a second weight part container 98, and a communication port 99. The first weight part container 97 is divided from the toner discharging portion 94 via a barrier 971, and is engraved from the entrance 941 of the toner discharging portion 94 at a first depth D1 equal to or greater than a diameter of the weight part 96 and formed in parallel to the toner discharging portion 94. The second weight part container 98 is engraved at a second depth D2 that is less than the first depth D1, from the entrance 941 toward the exit 942 of the toner discharging portion 94 to overlap the entrance 941 of the toner discharging portion 94 and the first weight part container 97. Due to the second weight part container 98, a height of the barrier 971 dividing the first weight part container 97 and the toner discharging portion 94 is lowered. That is, the second weight part container 98 reduces the height of the barrier 971.

The communication port 99 communicates the first weight part container 97 with the toner discharging portion 94. According to an example, the communication port 99 may include a first communication port 972 that extends from the barrier 971 to the bottom 973 of the first weight part container 97 to communicate the toner discharging portion 94 with the first weight part container 97. According to an example, the communication port 99 may further include a second communication port 974 that is connected to the first communication port 972 and connects the bottom 973 of the first weight part container 97 to the toner discharging portion 94 at an angle. The first communication port 972 and the second communication port 974 have a size smaller than a diameter of the weight part 96 such that the weight part 96 does not enter the toner discharging portion 94.

Figure 12:
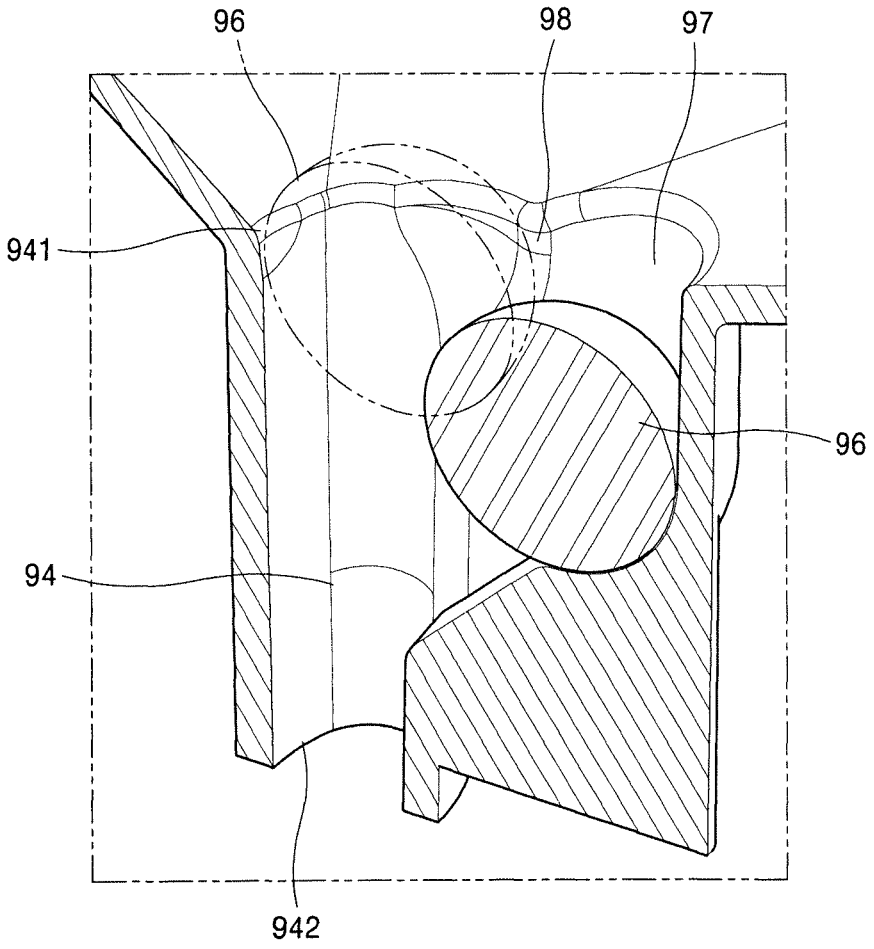
FIG. 12 is a cross-sectional view illustrating a position of a weight part in the example of the toner refill cartridge illustrated in FIGS. 10 and 11.
Figure 13:
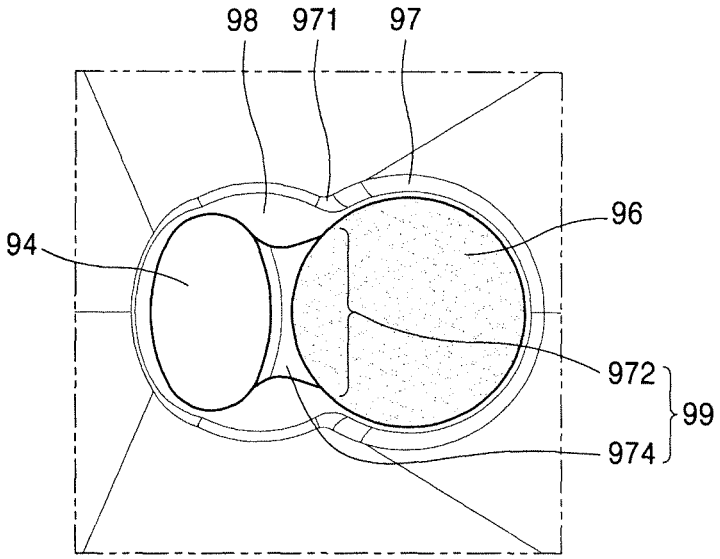
FIG. 13 is a horizontal cross-sectional view of a weight part located in a first weight part container in the example of the toner refill cartridge illustrated in FIGS. 10 and 11.
Figure 14:
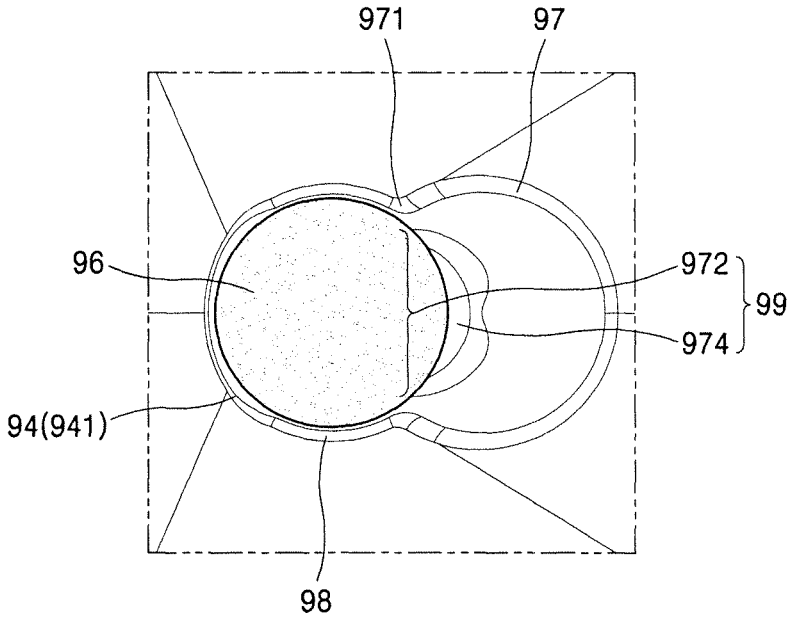
FIG. 14 is a horizontal cross-sectional view of a weight part located in a second weight part container in the example of the toner refill cartridge illustrated in FIGS. 10 and 11.

FIG. 12 is a cross-sectional view illustrating a position of the weight part 96 in the example of the toner refill cartridge 9 illustrated in FIGS. 10 and 11. FIG. 13 is a horizontal cross-sectional view of the weight part 96 located in the first weight part container 97. FIG. 14 is a horizontal cross-sectional view of the weight part 96 located in the second weight part container 98.

Referring to FIGS. 12 and 13, when the toner refill cartridge 9 is erected, the weight part 96 may be accommodated in the first weight part container 97. In this case, the toner discharging portion 94 is completely opened. Also, the weight part 96 does not interfere with the packing member 932 of the plunger 93 moving to the bottom dead position Q2. Thus, the plunger 93 may be moved to the bottom dead position Q2, and the toner in the toner chamber 92 may be discharged to the outside through the toner discharging portion 94.

When the first communication port 972 is provided, toner that has entered the first weight part container 97 from the toner chamber 92 may pass by the first communication port 972 to be discharged to the outside through the toner discharging portion 94. When the second communication port 974 is further provided, the toner that has entered the first weight part container 97 may be easily moved to the toner discharging portion 94 through the second communication port 974.

Referring to FIG. 12, when the toner refill cartridge 9 is erected, the weight part 96 may not be accommodated in the first weight part container 97 but placed on the entrance 941 of the toner discharging portion 94 as marked by a dashed line. The weight part 96 is held on the upper end of the barrier 971. According to the example, the second weight part container 98 that is engraved to overlap the entrance 941 of the toner discharging portion 94 and the first weight part container 97 is provided. Moving downward from the entrance 941 in the length direction A, the weight part 96 may be slightly moved toward the first weight part container 97 to be accommodated in the second weight part container 98.

In this state, as illustrated in FIG. 14, the toner chamber 92 is connected to the toner discharging portion 94 via the first weight part container 97 and the communication port 99. Accordingly, when the plunger 93 is moved in the length direction A, the toner in the toner chamber 92 may pass by the first weight part container 97 and the communication port 99 to be discharged to the outside through the toner discharging portion 94. When the first communication port 972 and the second communication port 974 are provided, the toner that has entered the first weight part container 97 may be more easily moved to the toner discharging portion 94 through the first communication port 972 and the second communication port 974.

A position of the weight part 96 placed on the entrance 941 of the toner discharging portion 94 in the length direction A is dependent on the height of the barrier 971. According to the example, the height of the barrier 971 is lowered by the second weight part container 98 as described above. In the example, the weight part 96 may be positioned at a further lowered position in the length direction A compared to the weight part 96 illustrated in FIG. 9 and marked by a dashed line. Accordingly, as the plunger 93 may be moved up to the bottom dead position Q2 or close to the bottom dead position Q2, a toner use efficiency may be improved.

While the examples of the toner refill cartridge 9 in which the weight part 96, which has a spherical shape, is used are described above, the shape of the weight part 96 is not limited to a sphere. When the weight part 96 is not a sphere, the 'diameter of the weight part 96' in the above description may be a 'maximum diameter' or a 'minimum diameter' depending on the circumstances. For example, a 'diameter of the weight part 96', compared with a diameter of the toner discharging portion 94, refers to a 'minimum diameter,' and a 'diameter of the weight part 96' compared with the first depth D1 may refer to a 'maximum diameter.'

While examples have been described with reference to the drawings, various changes in form and details may be made therein without departing from the spirit and scope as defined by the following claims.

What is claimed is:

1. A toner refill cartridge, comprising:

a body including a toner chamber to contain toner and a toner discharging portion having an entrance connected to one end of the toner chamber in a length direction and an exit to discharge toner outside of the toner refill cartridge;

a plunger including a piston movably inserted into the toner chamber in the length direction and a packing member located at an end of the piston to push the toner toward the toner discharging portion;

a weight part movable in the toner chamber and having a shape which prevents the weight part from passing through the entrance; and a weight part container provided in the one end of the toner chamber in the length direction to accommodate the weight part, the weight part container partitioned from the toner discharging portion via a barrier.

2. The toner refill cartridge of claim 1, wherein the weight part container includes a first weight part container partitioned via the barrier from the entrance and having a first depth which extends in the length direction from the entrance to a bottom of the first weight part container.

3. The toner refill cartridge of claim 2, wherein the first depth is equal to or greater than a diameter of the weight part.

4. The toner refill cartridge of claim 2, comprising a first communication port which extends from the barrier to the bottom of the first weight part container to provide a passage between the toner discharging portion and the first weight part container.

5. The toner refill cartridge of claim 4, comprising a second communication port connected to the first communication port and having an angled surface provided from the bottom of the first weight part container to the toner discharging portion.

6. The toner refill cartridge of claim 5, wherein the first communication port and the second communication port have a size smaller than a diameter of the weight part so that when the weight part is accommodated in the first weight part container the weight part is prevented from entering the toner discharging portion.

7. The toner refill cartridge of claim 5, comprising a second weight part container having a second depth smaller than the first depth, the second weight part container being provided from the entrance toward the exit such that the second weight part container overlaps at least a portion of the entrance and at least a portion of the first weight part container.

8. The toner refill cartridge of claim 7, wherein a diameter of the second weight part container is less than a diameter of the first weight part container.

9. The toner refill cartridge of claim 1, wherein a planar shape of the entrance viewed in the length direction includes a minor axis and a major axis, a length of the minor axis is less than a diameter of the weight part, and a length of the major axis is greater than the diameter of the weight part.

10. The toner refill cartridge of claim 1, wherein a bottom of the packing member is concave.

11. A toner refill cartridge, comprising:

a body including a toner chamber to contain toner and a toner discharging portion having an entrance connected to one end of the toner chamber in a length direction and an exit to discharge toner outside of the toner refill cartridge;

a plunger movable in the toner chamber in the length direction to push the toner through the toner discharging portion to the outside of the toner refill cartridge;

a weight part movable in the toner chamber and having a shape which prevents the weight part from passing through the entrance;

a first weight part container divided from the toner discharging portion via a barrier, having a first depth which is equal to or greater than a diameter of the weight part, and provided in parallel to the toner discharging portion;

a second weight part container having a second depth less than the first depth, provided from the entrance toward the exit such that the second weight part container overlaps at least a portion of the entrance and at least a portion of the first weight part container; and a communication port to provide a passage between the first weight part container and the toner discharging portion.

12. The toner refill cartridge of claim 11, wherein the communication port includes a first communication port which extends from the barrier to a bottom of the first weight part container to provide the passage between the first weight part container and the toner discharging portion.

13. The toner refill cartridge of claim 12, wherein the communication port includes a second communication port connected to the first communication port and having an angled surface provided from the bottom of the first weight part container to the toner discharging portion.

14. The toner refill cartridge of claim 13, wherein the first communication port and the second communication port have a size smaller than a diameter of the weight part such that the weight part is prevented from entering the toner discharging portion.

15. The toner refill cartridge of claim 1, wherein the one end of the toner chamber is tilted toward the entrance of the toner discharging portion.

16. The toner refill cartridge of claim 1, wherein the toner discharging portion is located to be deviated from a central axis of the body.

17. A toner refill cartridge comprising:

a body including:

a toner chamber to contain toner; and a toner discharging portion having an entrance connected to one end of the toner chamber in a length direction and an exit to discharge toner outside of the toner refill cartridge, wherein the toner discharging portion is located to be deviated from a central axis of the body;

a plunger including a piston movably inserted into the toner chamber in the length direction and a packing member located at an end of the piston to push the toner toward the toner discharging portion;

a weight part movable in the toner chamber and having a shape which prevents the weight part from passing through the entrance; and a weight part container provided in the one end of the toner chamber in the length direction to accommodate the weight part.

18. The toner refill cartridge of claim 17, wherein the weight part container includes a first weight part container partitioned from the entrance and having a first depth which extends in the length direction from the entrance to a bottom of the first weight part container.

19. The toner refill cartridge of claim 18, comprising a barrier to partition the toner discharging portion from the first weight part container.

20. The toner refill cartridge of claim 19, comprising a first communication port which extends from the barrier to the bottom of the first weight part container to provide a passage between the toner discharging portion and the first weight part container.

* * * * *